US012478155B2

(12) United States Patent
Dufelmeier

(10) Patent No.: US 12,478,155 B2
(45) Date of Patent: Nov. 25, 2025

(54) WALLET WITH STRUCTURE TO LIMIT LATERAL DISPLACEMENT

(71) Applicant: FELLOWES MOBILE LLC, Itasca, IL (US)

(72) Inventor: Jack Dufelmeier, Chicago, IL (US)

(73) Assignee: Fellowes Mobile LLC, Itasca, IL (US)

( * ) Notice: Subject to any disclaimer, the term of this patent is extended or adjusted under 35 U.S.C. 154(b) by 18 days.

(21) Appl. No.: 18/478,814

(22) Filed: Sep. 29, 2023

(65) Prior Publication Data

US 2025/0107602 A1 Apr. 3, 2025

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/067* (2013.01)

(58) Field of Classification Search
CPC .... A45C 11/182; A45C 1/06; A45C 2001/067
See application file for complete search history.

(56) References Cited

U.S. PATENT DOCUMENTS 3,970,129 A * 7/1976 Tepfer ..... A45C 11/18 150/900
3,971,458 A * 7/1976 Koenig ..... A45C 13/42 24/387
5,125,505 A * 6/1992 Kurosaki ..... G09F 3/18 206/556
5,865,307 A * 2/1999 Friedman ..... A45C 13/1092 206/37.1
7,122,763 B1 * 10/2006 Liu ..... A45C 11/20 219/214
8,205,752 B2 * 6/2012 Sack ..... B65D 83/0463 206/538
11,344,091 B2 * 5/2022 Goodwin ..... A45C 13/1069
2009/0045078 A1 * 2/2009 Gelardi ..... B65D 83/0463 220/694
2012/0067473 A1 * 3/2012 Khounsombath ..... A45C 1/06 150/147
2013/0276943 A1 * 10/2013 Minn ..... A45C 1/06 150/137
2015/0083289 A1 * 3/2015 Johnson ..... A45C 1/06 150/144

(Continued)

*Primary Examiner* — Don M Anderson
*Assistant Examiner* — Justin Caudill
(74) *Attorney, Agent, or Firm* — Wood, Phillips, Katz, Clark, & Mortimer

(57) ABSTRACT

A wallet or case to hold data cards such as credit cards and identification cards. The wallet includes two panels joined by an elastic or expanding and contracting structure so that the wallet may expand top accommodate more cards, and contract to hold less cards and maintain a downward bias or pressure on the stack of cards in the wallet. The wallet includes complementary structures on the two panels to interfere with each other in a lateral direction to limit or prevent the lateral displacement of one panel relative to the other. The structures may include posts and receivers in the panels. In some embodiments, the posts and receivers include additional enhancements to allow the structures to remain in interface for a greater distance of wallet expansion and contraction.

18 Claims, 9 Drawing Sheets

(56) References Cited

U.S. PATENT DOCUMENTS

| | | | | |
|---|---|---|---|---|
| 2015/0342314 | A1* | 12/2015 | Christy | A45C 11/182<br>206/38 |
| 2019/0375087 | A1* | 12/2019 | Liang | A45C 1/06 |
| 2023/0136219 | A1* | 5/2023 | Zhang | A45C 13/185<br>150/131 |
| 2023/0284758 | A1* | 9/2023 | Espartero | A45C 11/321 |

* cited by examiner

WALLET WITH STRUCTURE TO LIMIT LATERAL DISPLACEMENT

BACKGROUND OF THE INVENTION

Field of the Invention

The invention relates to wallets or cases, and more specifically to cases used to hold or store data cards and allow access to the cards and allow additional card to the added to the case. The cases are typically associated with and attach to cases for portable electronic devices. However, the cases of the present invention need not be associated with any additional cases.

Background Art

Portable electronic devices such as cell phones are commonly protected with cases that are paced over the manufacturer provided housing of the device. Such cases may include areas for additional storage of data cards, money, identification cards, and other personal items that one may commonly carry in a wallet. To distinguish from the portable electronic device case, the case that holds data cards may be described herein as a wallet.

Some phone cases presently include or mate with a wallet that may hold data cards. Such wallets generally include a front panel and a rear panel joined together about portions of the perimeter of the panels to form a pocket to receive the cards. Such panels are typically stiff and planar, and joined by structures that allow the space or envelope between the panels to expand to allow the user to add data cards or other items, and contract or relax when the user removes cards. The panels are biased to the relaxed position to maintain pressure on the stack of items to minimize the height of the wallet and to create friction to retain the cards within the pocket of the wallet.

The structures joining the panels together to form the pocket often is a fabric or other elastomeric material. These materials, by their very nature of being elastic or being pliable materials, generally do not prevent the top and bottom panels from being displaced laterally from each other when lateral forces are applied to the panels, such as when a user inserts or removes a card. One will recognize that a lateral force or direction is generally within or has a component in the plane of the panels. Such lateral displacement, besides creating an unsecure feeling for the user who stores valuable data cards in the wallet, can make it more difficult to remove or insert the data cards.

The wallet also has contradictory goals. One goal is to accommodate many cards. Another goal is to be as thin as possible. Of course the increase in the number of data cards increases the overall thickness of the wallet holding the cards.

In order to be as thin as possible overall, the thickness of the panels of the wallet needs to be as thin as possible. The thinness of the panels however, presents challenges for creating structures that limit the lateral displacement of the panels with respect to each other.

SUMMARY OF THE INVENTION

The invention is an assembly that allows for alignment and retention of the upper and lower panels of the wallet. In the most basic form, the alignment device is a protrusion on one panel that is received by a respective receivers on the other panel. These may be referred to as paired complementary structures. There may be a plurality of such structures on the wallet. The paired or complementary structures may be placed near the corners of the respective panels that form the wallet.

One skilled in the art will recognize the structures that make up the paired complementary structures described herein may be placed on either panel. That is structures described as being on the top panel may instead be on the bottom panel, and visa-versa. One skilled in the art will also recognize that where a plurality of structures are present, such as near the corners of the wallet, the protrusions or receivers need not all be on the same panel. For instance, the top panel may have one protrusion and three receivers while the bottom panel may have one receiver and three protrusions.

To increase the storage capacity, enhancements to the structures to limit lateral displacement may be used. Such enhancements include additional projections about the receivers and receptacles about the protrusions that allow the protrusions and receivers to remain in contact or nested for a greater distance.

The structures to limit lateral displacement or movement may also take different forms. Herein the structures are generally rectangular, but other shapes may be used. In the broadest sense, the structures may be of any configuration which results in limiting the lateral displacement in any lateral direction of the two panels relative to one another.

In one form, the invention is directed to a wallet for holding data cards. The wallet includes a top panel and a bottom panel. The top panel is joined to the bottom panel by a connecting structure. The connecting structure has a bias placing the wallet in a relaxed state. The bias provides a force to draw the top and bottom panels together when the wallet is in an expanded state. The wallet further includes at least one protrusion extending from one of the top or bottom panel and a receiver in the other of the top or bottom panel. The protrusion received in the receiver limits lateral movement of the top panel with respect to the bottom panel.

In one form, the protrusion is rectangular.

In one form, the receiver is an aperture.

In one form, the protrusion is in the receiver when the wallet is in a relaxed state and when the wallet is in an expanded state.

In one form, the receiver includes tapered walls.

In one form, the receiver includes an extension extending away from the other of the top or bottom panel.

In one form, the one of the top or bottom panel includes a receptacle. The receptacle is aligned with the extension.

In one form, the connecting structure includes a connecting structure aperture. The protrusion is within the connecting structure aperture.

In one form, the invention is directed to a wallet for holding data cards. The wallet includes a top panel, a bottom panel, and a means for elastically connecting the top panel to the bottom panel. One of the top panel or bottom panel includes means for limiting lateral movement of the one of the top panel or bottom panel with respect to an other of the top panel or bottom panel. The other of the top panel or bottom panel includes means for receiving the means for limiting lateral movement.

In one form, the means for limiting lateral movement includes a receptacle to receive the means for limiting lateral movement from the other of the top panel or bottom panel.

In one form, the means for elastically connecting surrounds the means for limiting lateral movement.

In one form, the invention is directed to a wallet for holding data cards. The wallet includes: a top panel having at least one protrusion on its inside surface; a bottom panel having at least one corresponding receiver on its inside surface; and a joining structure connecting the top panel and the bottom panel. The protrusion and the receiver form paired complementary structures facilitating alignment and retention of said upper and lower panels. The joining structure has a bias that places the wallet in a relaxed state and applies force to draw the top and bottom panels together when the wallet is in an expanded state.

In one form, the protrusion is a rectangular post that extends from the inside surface of the top panel.

In one form, the receiver is an aperture in the inner surface of the bottom panel.

In one form, the paired complementary structure is positioned near the corners of the top and bottom panels that form the wallet.

In one form, the receiver features tapered walls.

In one form, the protrusion remains within the receiver both in a relaxed state and when the wallet is in an expanded state.

In one form, the receiver includes an extension that extends above and away from the inside surface of the bottom panel. The extension forms an annular wall about the perimeter of the receiver and extends towards the inner surface of the top panel.

In one form, the wallet further includes a receptacle located adjacent to the protrusion on the inside surface of the top panel. The receptacle extends towards the outer surface of the top panel and aligns with the receiver.

In one form, the connecting structure is a coil spring.

DETAILED DESCRIPTION OF THE PREFERRED EMBODIMENT

Figure 1:
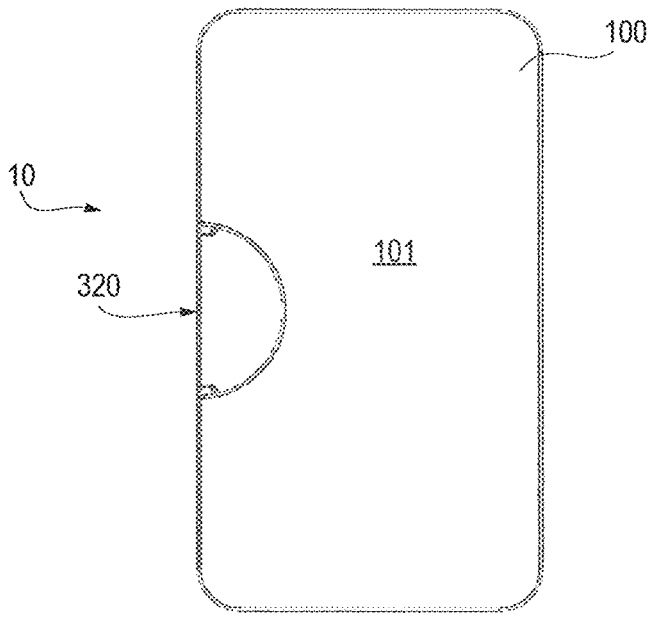
FIG. 1 is a top view of a wallet of the present invention.
Figure 3:
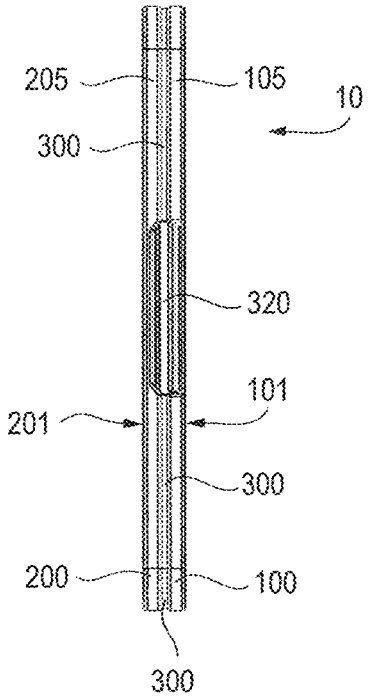
FIG. 3 is an ejection slot side view of the wallet of the present invention.
Figure 2:
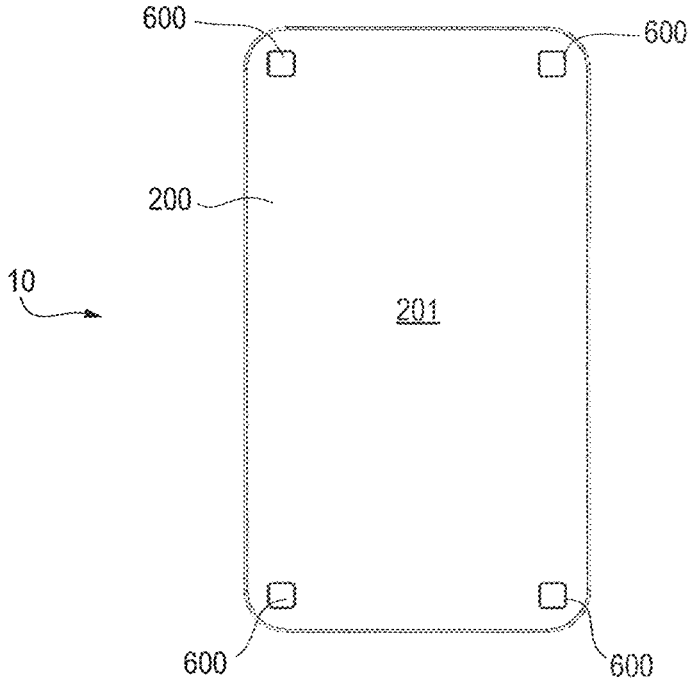
FIG. 2 is a bottom view of the wallet of the present invention.
Figure 4:
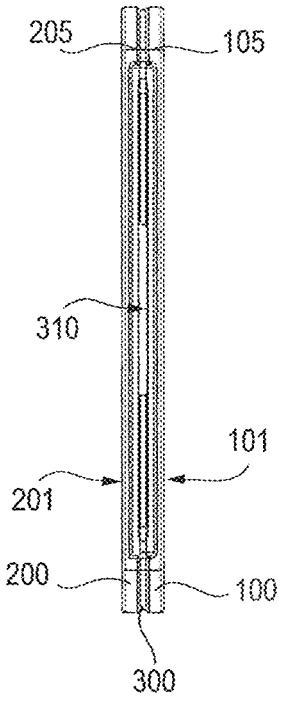
FIG. 4 is a card insertion slot side view of the wallet of the present invention.
Figure 5:
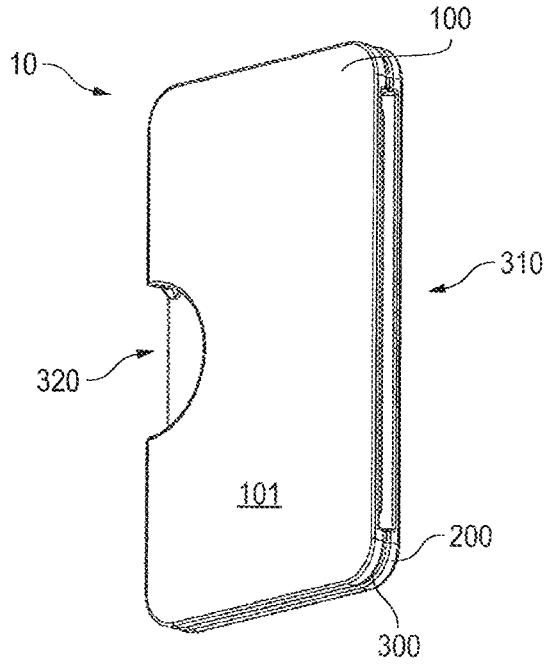
FIG. 5 is a top perspective view of the wallet of the present invention.
Figure 6:
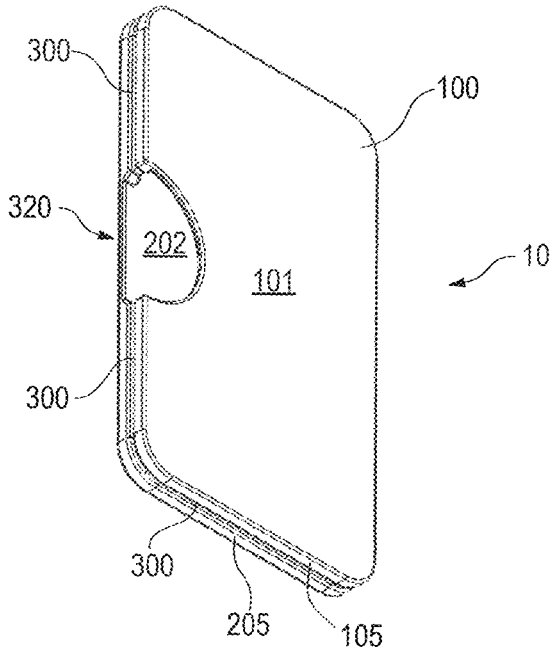
FIG. 6 is a top perspective view of the wallet of the present invention.
Figure 7:
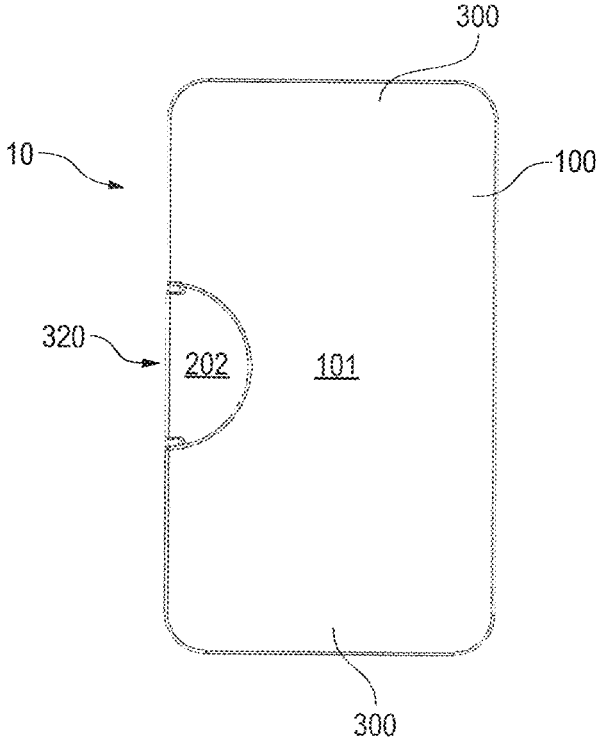
FIG. 7 is a top plan view showing internal components.
Figure 8:
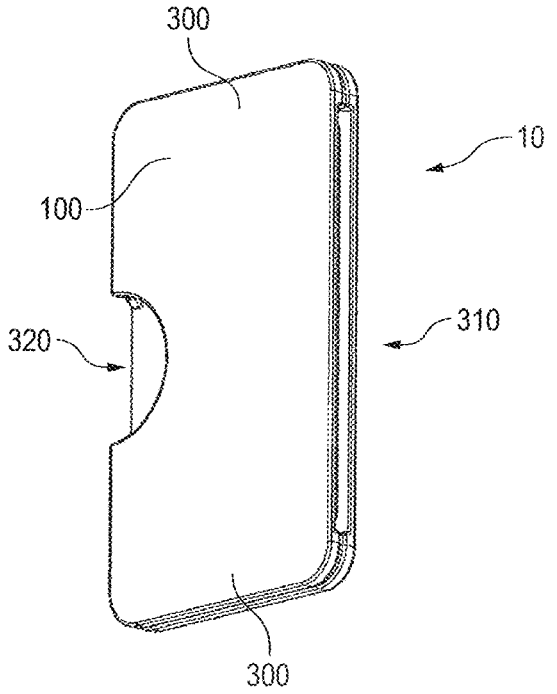
FIG. 8 is a top perspective view showing internal components.
Figure 9:
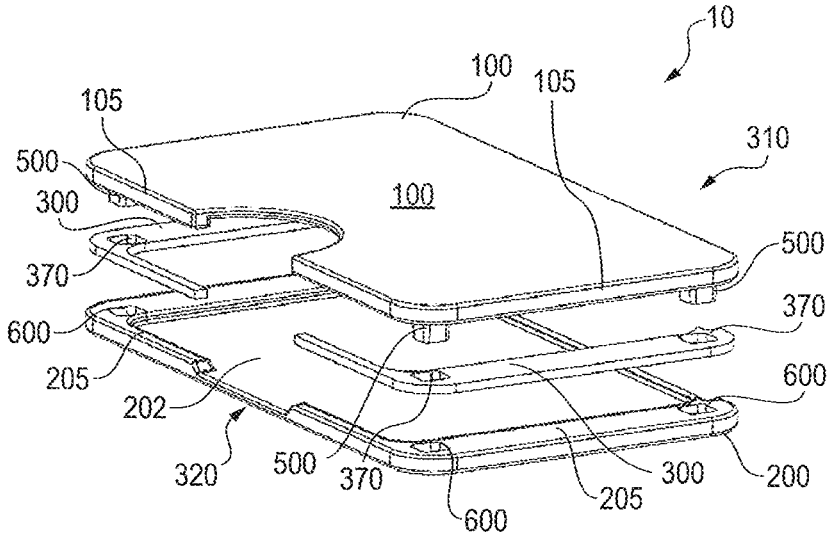
FIG. 9 is an exploded top perspective view of a wallet of the present invention.
Figure 10:
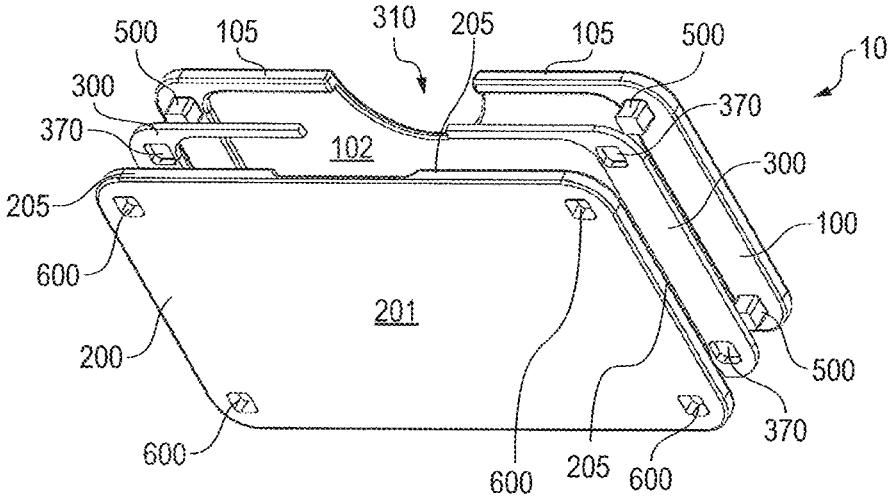
FIG. 10 is a bottom perspective view of a wallet of the present invention.
Figure 11:
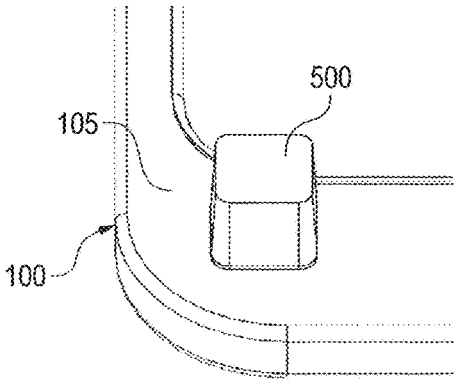
FIG. 11 is a closeup view of a structure to limit lateral movement.
Figure 12:
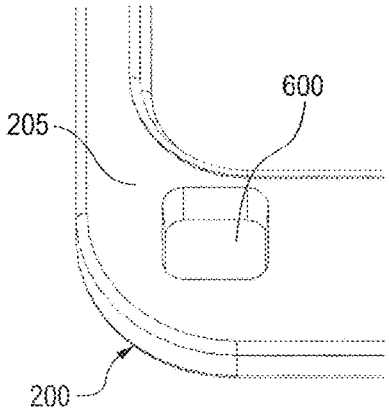
FIG. 12 is a closeup view of an aperture to receive the structure in FIG. 11 to limit lateral movement.
Figure 13:
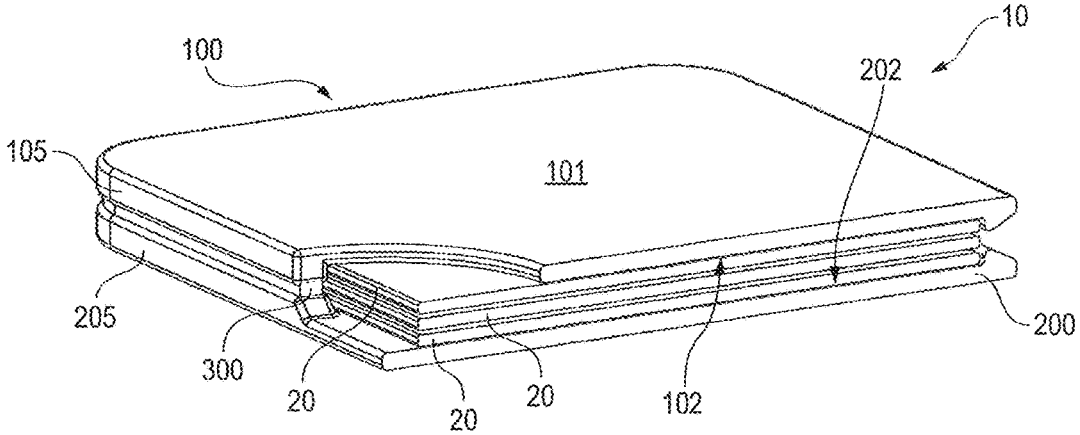
FIG. 13 is a cross-sectional perspective view of a wallet in a relaxed state holding data cards.
Figure 14:
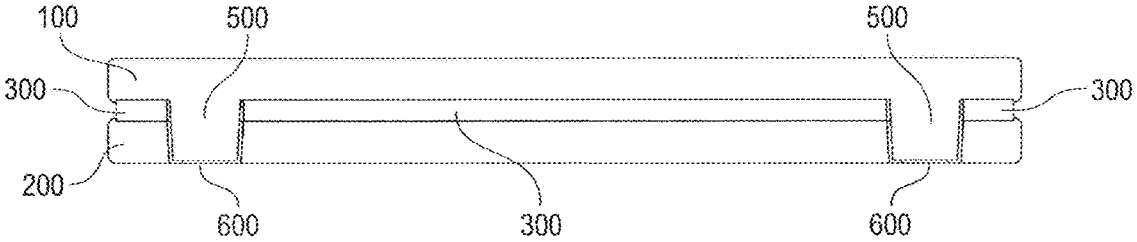
FIG. 14 is a cross-sectional view of wallet in a relaxed state, showing the protrusions aligned within the receivers to limit lateral movement.
Figure 15:
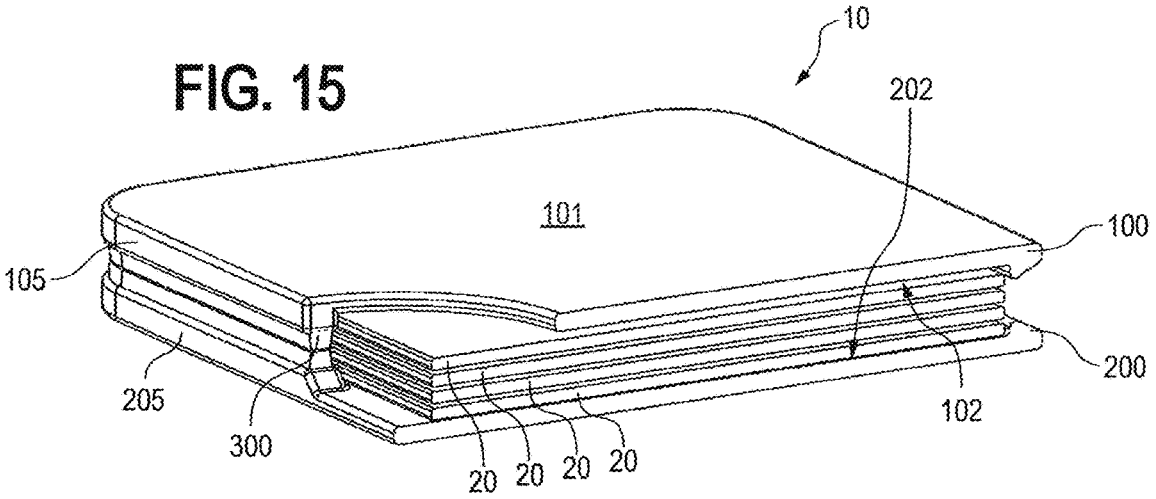
FIG. 15 is a cross-sectional perspective view of a wallet in an expanded state, holding data cards.
Figure 16:
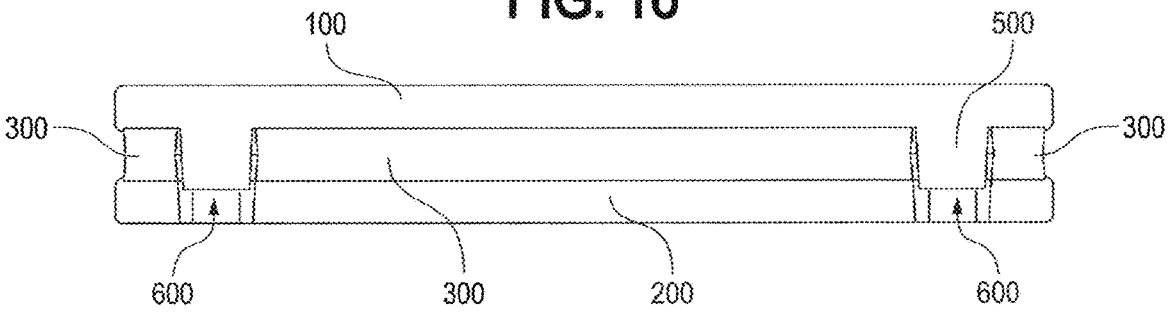
FIG. 16 is a cross sectional view of a wallet in an expanded state showing the protrusions aligned within the receivers to limit lateral movement, protrusions at the limit of being able to limit lateral movement.
Figure 17:
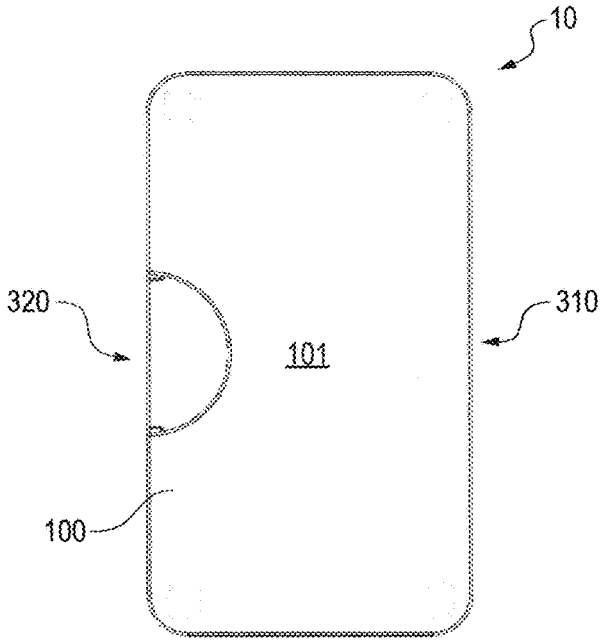
FIG. 17 is a top view of a wallet of the present invention showing internal components.
Figure 18:
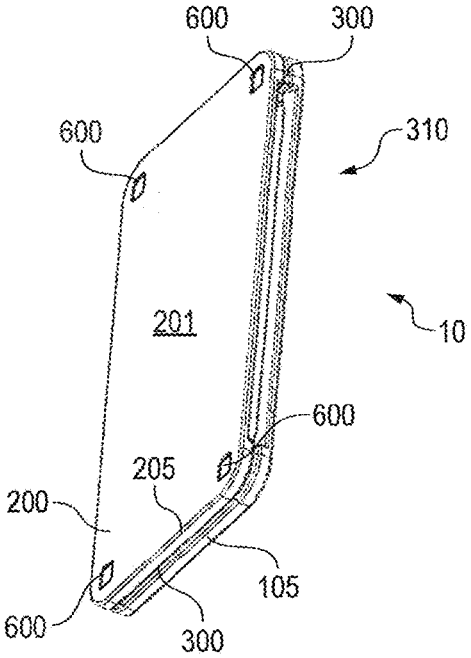
FIG. 18 is a bottom perspective view of a wallet of the present invention showing internal components.
Figure 19:
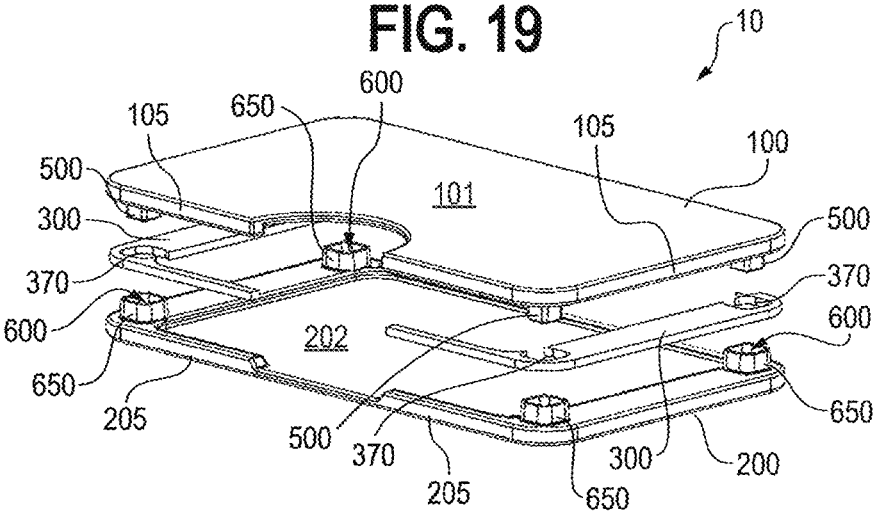
FIG. 19 is an exploded top perspective view of a wallet of the present invention.
Figure 20:
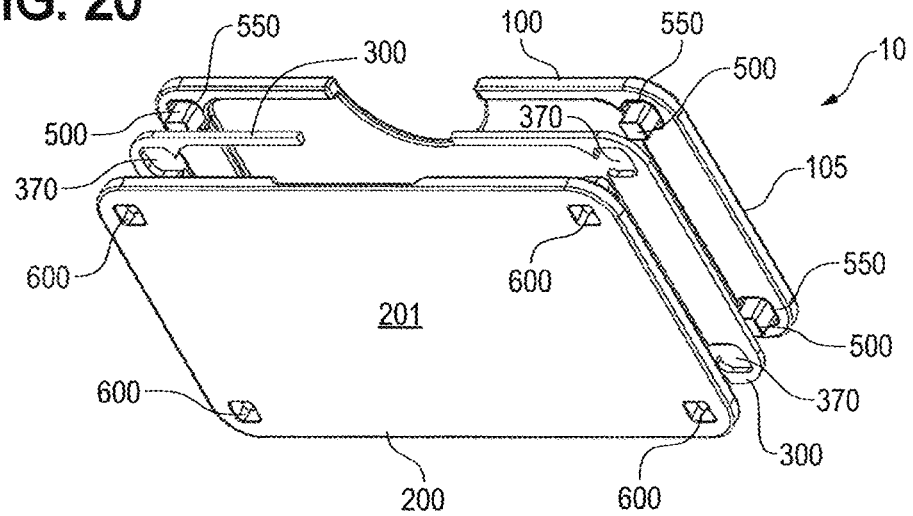
FIG. 20 is an exploded bottom perspective view of a wallet of the present invention.
Figure 21:
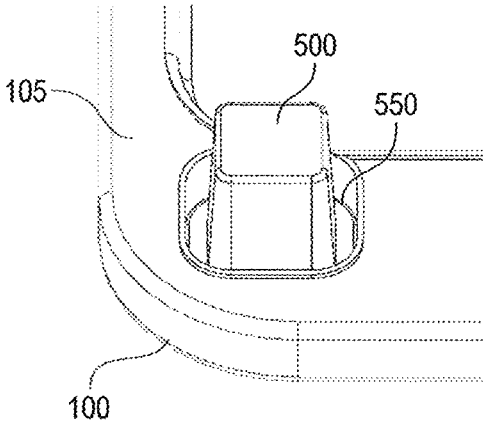
FIG. 21 is a close-up view of a structure to limit lateral movement.
Figure 22:
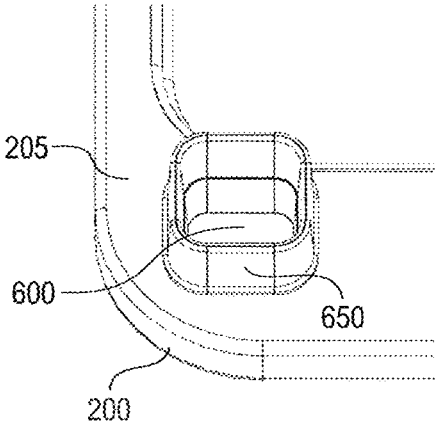
FIG. 22 is a close-up view of an aperture with extending annular walls to receive the structure of FIG. 21.
Figure 23:
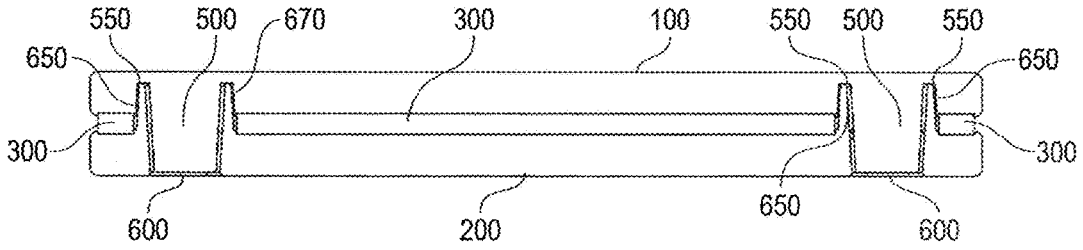
FIG. 23 is a cross-sectional view showing the protrusions aligned within the receivers and nesting with the receivers to limit lateral movement.
Figure 24:
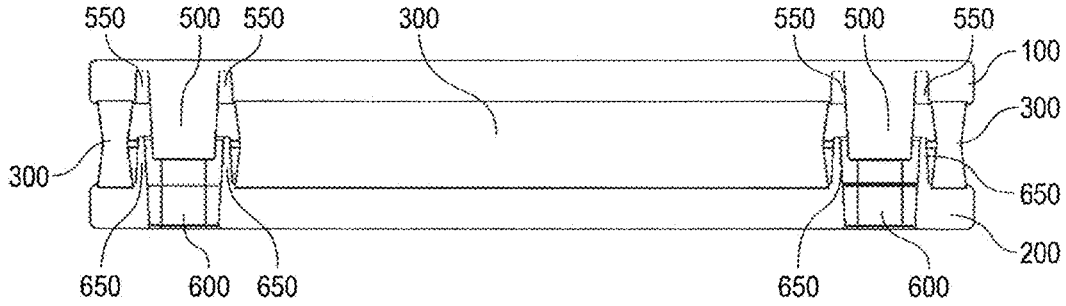
FIG. 24 is a cross sectional view of a wallet in an expanded state showing the protrusions aligned within the extended walls to limit lateral movement, the protrusions at the limit of being able to limit lateral movement.
Figure 25:
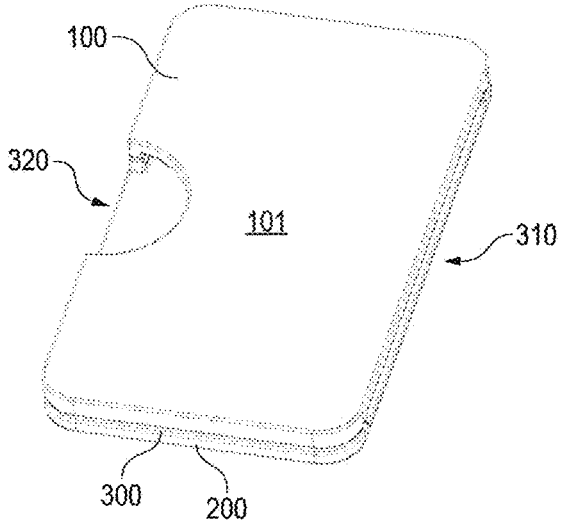
FIG. 25 is a top perspective of a wallet of the present invention showing internal components, including springs as a joining structure.
Figure 26:
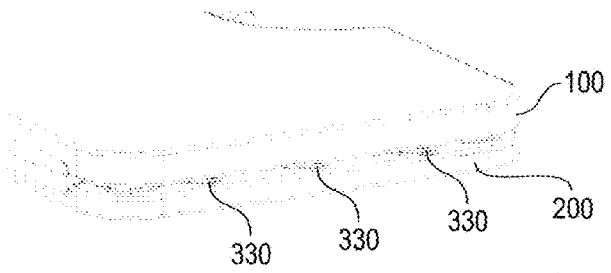
FIG. 26 is a partial side perspective of a wallet of the present invention in a relaxed state, including springs as a joining structure.
Figure 27:
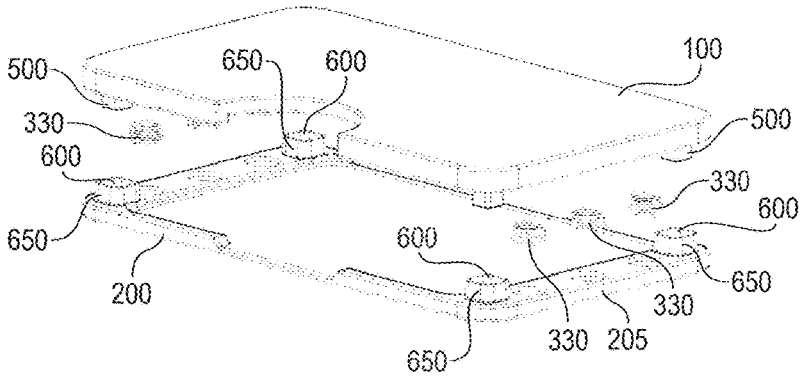
FIG. 27 is an exploded top perspective view of a wallet of the present invention using springs as a joining structure.
Figure 28:
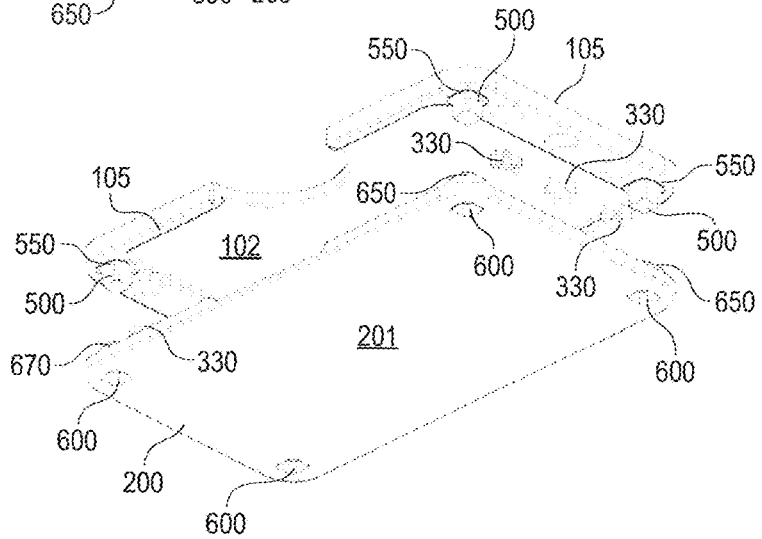
FIG. 28 is an exploded bottom perspective view of a wallet of the present invention using springs as a joining structure.
Figure 29:
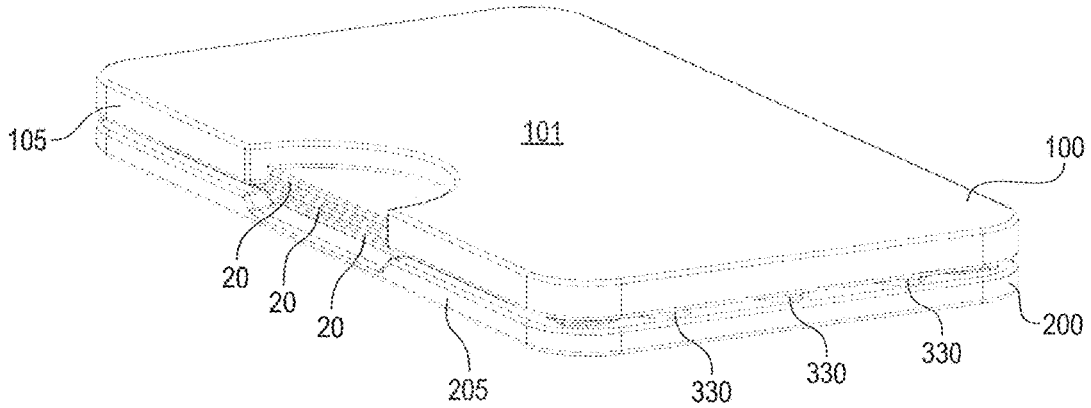
FIG. 29 is a top perspective view of a wallet of the present invention in a relaxed state using springs as a joining structure.
Figure 30:
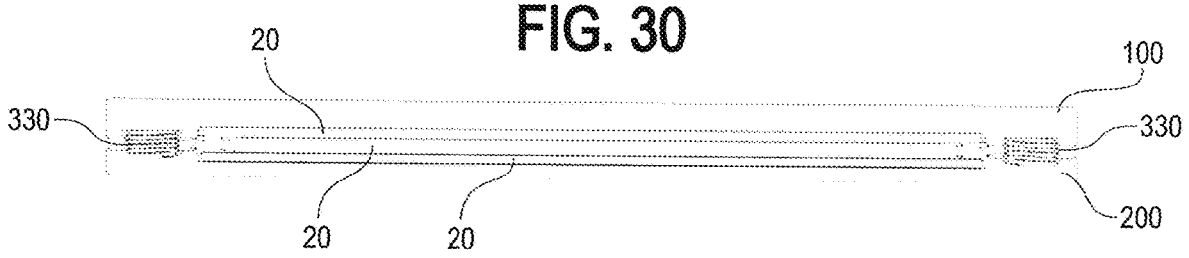
FIG. 30 is a side cross-sectional view of a wallet of the present invention in a relaxed state using springs as a joining structure.
Figure 31:
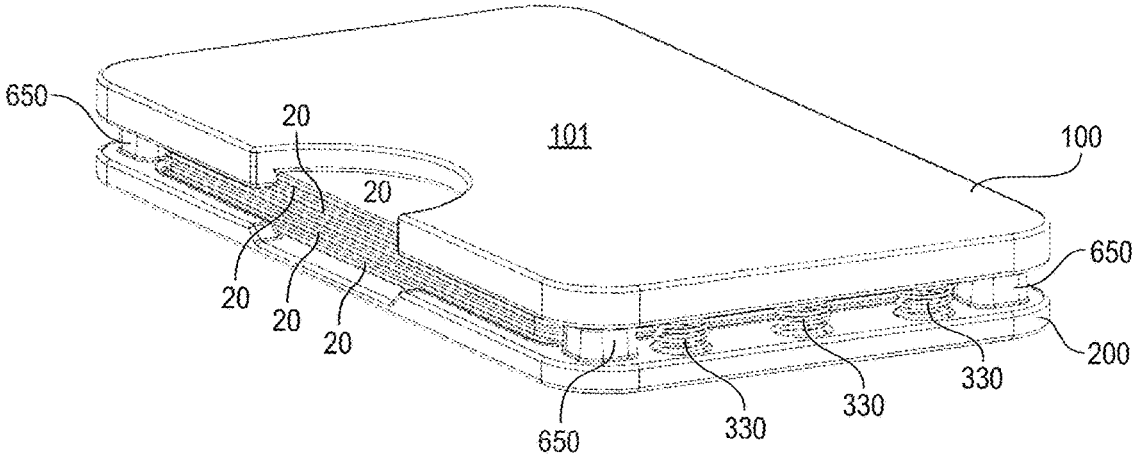
FIG. 31 is a is a top perspective view of a wallet of the present invention in an expanded state using springs as a joining structure.
Figure 32:
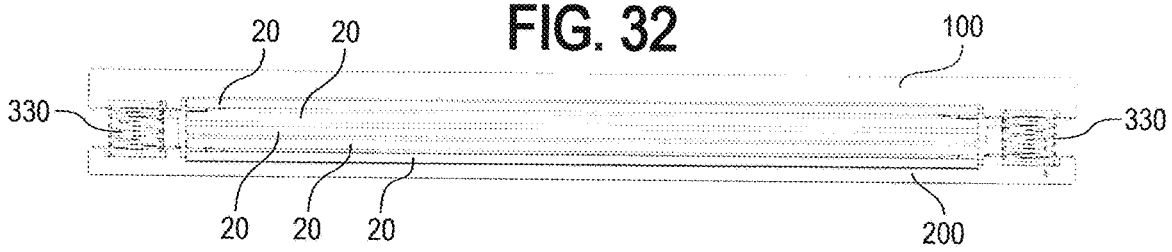
FIG. 32 is a side cross-sectional view of a wallet of the present invention in an expanded state using springs as a joining structure.

With reference to the figures, the wallet 10 includes a top panel 100 and a bottom panel 200. The top panel 100 is joined to the bottom panel 200 by at least one connecting or joining structure 300.

In some embodiments, the top panel 100 is generally rectangular and planar. It is sized to be larger than a credit card in width and length to accommodate structures to limit lateral movement. The top panel 100 has an outside surface 101 and an inside surface 102. The top panel 100 is generally between 0.8 mm and 1.2 mm in thickness between the outside surface 101 and the inside surface 102, but such thickness may vary. The top panel 100 may include perimeter walls 105. The perimeter walls 105 may extend away from the inside surface 102. In some embodiments, the perimeter walls 105 may be considered part of the inside surface 102.

In some embodiments the bottom panel 200 is generally sized similarly to the top panel, but need not be. One skilled in the art will recognize it may be beneficial to have a bottom panel that is thicker than the top panel to allow for additional engagement or keying with any protrusions or other structures to align or limit lateral movement of the top panel 100 and bottom panel 200.

In some embodiments, the bottom panel 200 is generally rectangular and planar. It is sized to be larger than a credit card in width and length to accommodate structures to limit lateral movement. The bottom panel 200 has an outside surface 201 and an inside surface 202. The bottom panel 200 is generally 0.8 mm to 1.2 mm in thickness between the outside surface 201 and the inside surface 202, but the thickness may vary. The bottom panel 200 may include perimeter walls 205. The perimeter walls 205 may extend away from the inside surface 202. In some embodiments, the perimeter walls 205 may be considered part of the inside surface 202. In some embodiments, the top panel 100 is joined to the bottom panel 200 by joining structure 300. The joining structure may be a material that is elastomeric, or is allowed to stretch, allowing the distance between the inside surfaces 102 and 202 of the top and bottom panels 100 and 200 to increase or decrease. The joining structure may also maintain a downward or closing bias to keep pressure on the data cards or other items present in the envelope or space between the top panel 100 and bottom panel 200. Thus the resulting envelope will have a relaxed capacity and an expanded capacity. Examples of joining structures are fabric and elastomers such as elastic nylon, synthetic fibers, elastomeric polymers, stretchable silicone, rubber, or any other material that will allow for expansion and contraction of the pocket or envelope for holding the data cards 20.

In some embodiments, the joining structure 300 is attached to at least a portion of the top panel perimeter walls 105 and to at least a portion of the bottom panel perimeter walls 205. The joining structure 300 may be joined to a panel in any conventional way, including adhesive, co-molding, mechanical fasteners, welding, and the like.

In some embodiments, the perimeter walls 205 need not be continuous. The joining structure may include gaps about the perimeter. Such gaps may include an insertion slot 310 to allow a user to insert data cards 20 into the wallet 10. Such gaps may also include an ejection slot 320 that allows a user to push on a data card 20 to eject or remove the data card from the wallet 10. Other gaps may also exist in the joining structure. In some embodiments the gap in the joining structure may be coextensive with a gap in a perimeter wall 205 if the bottom panel 200, or a gap in a perimeter wall 105 of the top panel 105.

In some embodiments the joining structure 300 includes apertures 370. The apertures 370 accommodate or receive the structures to limit lateral movement. The structures to limit lateral movement may then pass through the joining structure 300. In some embodiments, the joining structure may surround a portion of the structure to limit lateral movement rather than surround the entire outer perimeter of the structure. In some embodiments, the joining structure has a gap where the structures to limit lateral movement are present.

In some embodiments, the joining structure 300 may include springs 330. The springs 330 may include coil springs. The springs may be located or positioned along a portion of the perimeter of the top panel 100 and bottom panel 200. In the most preferred embodiment, the springs are positioned on perimeter portions that do not include a card insertion slot 310 or an ejection slot 320. The springs may be placed in recesses in the panels to allow for a maximum amount of spring travel and recoil given a particular distance.

In some embodiments, the structures to limit lateral movement may include protrusions 500 extending away from the inside surface 102 of the top panel. In some embodiments, the protrusions 500 may extend from the perimeter wall 105. In some embodiments, a portion of the perimeter wall may be considered part of a protrusion 500. In some embodiments, the perimeter wall may be considered part of the inner surface 102.

The protrusions 500 may be located at or near the corners of the top panel 100. One skilled in the art will recognize the protrusion 500 may be located at many positions that are outside of the footprint of the data cards 20. The protrusions may take many shapes, though it is preferred that the protrusions include flat walls to limit twisting movement. In the most preferred embodiment, the protrusions 500 are rectangular protrusions extending normal to the inside surface 102. The protrusions 100 may taper away from the inside surface 102, but such tapering is not required.

In some embodiments the bottom panel 200 includes a plurality of receivers 600 in the inner surface 202 of the bottom panel 200 to receive the protrusions 500. In some embodiments, the receivers are in the perimeter walls 205. In the most basic form, the receivers are depressions or apertures in the inner surface 202 or perimeter walls 205. In some embodiments, the receivers may extend from the perimeter wall 205. In some embodiments, a portion of the perimeter wall 205 may be considered part of a receiver. In some embodiments, the perimeter wall may be considered part to the inner surface 202.

The receivers may be apertures that communicate from the inner surface 202 to the outer surface 201 of the bottom panel 200. The receivers 600 may be located opposing or aligned with the protrusions 500. It is preferred the receivers 600 are of complementary shape to the protrusions 500 so that the protrusions are easily received. In the most preferred embodiment, the receivers 600 are generally rectangular in shape. The receivers 600 may include a taper away from the inside surface 202 of the bottom panel 200 so that the receiver 600 becomes narrower. This taper may correspond to the taper of the corresponding protrusion 500. The taper allows the protrusion to better reset into the receiver 600 should the protrusion 500 become displaced from the receiver 600.

In the most preferred embodiment, the receiver 600 is deep enough to accommodate the protrusion 500 when the wallet 10 is in a relaxed state. When the wallet 10 is in the most expanded state to contain the most data cards 20, a protrusion 500 should still be at least partially in a receiver 600 to limit lateral displacement of the top 100 and bottom 200 panels with respect to each other.

To improve the ability to hold the maximum number of data cards 20 for a given thickness of the panels, it is preferred to have the protrusion 500 and the receiver 600 nest more fully. In some embodiments a receptacle 550 is located adjacent the protrusion. The receptacle 550 extends away from the inner surface 102 of the top panel 100 or perimeter wall 105 towards the outer surface 101 of the top panel 100. In the most preferred embodiment, the receptacle 550 is a moat about the protrusion 500. The receptacle 550 need not be continuous about the protrusion 500, but it must be positioned to accept and align with complimentary structure related to the receiver 600.

In some embodiments the receiver 600 includes an extension 650 positioned above and extending away from the inside surface 102 of the bottom panel 200 or the perimeter wall 205. In the most preferred embodiment, the extension 650 is an annular wall about the perimeter of the receiver

600 extending from the inner surface 202 of the bottom panel or perimeter wall 205 towards the inner surface of the top panel 100. The extension 650 need not be continuous about the protrusion 500. In the most preferred embodiment, the annular wall and the walls of the receiver 600 combine to form a deeper receiver to allow for an increased expanded state for the wallet 10 while still allowing at least a portion of the protrusion to remain within the extended receiver and limit the lateral displacement. When the wallet 10 is in the relaxed state, the extension 650 is accepted and aligned with the corresponding receptacle 550.

The foregoing disclosure of specific embodiments is intended to be illustrative of the broad concepts comprehended by the invention and not limiting to the invention.

The invention claimed is:

1. A wallet for holding data cards, the wallet including a top panel and a bottom panel, the top panel joined to the bottom panel by a connecting structure, the connecting structure having a bias placing the wallet in a relaxed state, the bias providing a force to draw the top and bottom panels together when the wallet is in an expanded state, the wallet further including at least one protrusion extending from one of the top or bottom panel and a receiver in the other of the top or bottom panel, the protrusion received in the receiver limiting lateral movement of the top panel with respect to the bottom panel.

2. The wallet of claim 1 wherein the protrusion is rectangular.

3. The wallet of claim 1 where the receiver is an aperture.

4. The wallet of claim 1 wherein the protrusion is in the receiver when the wallet is in the relaxed state and when the wallet is in the expanded state.

5. The wallet of claim 1 wherein the receiver includes tapered walls.

6. The wallet of claim 1 wherein the receiver includes an extension extending away from the other of the top or bottom panel.

7. The wallet of claim 6 wherein the one of the top or bottom panel includes a receptacle, the receptacle aligned with the extension.

8. The wallet of claim 1, wherein the connecting structure includes a connecting structure aperture, the protrusion being within the connecting structure aperture.

9. The wallet of claim 1 wherein the connecting structure is a coil spring.

10. A wallet for holding data cards, comprising: a top panel having at least one protrusion on its inside surface; a bottom panel having at least one corresponding receiver on its inside surface, said protrusion and said receiver forming paired complementary structures facilitating alignment and retention of said upper and lower panels; and a joining structure connecting the top panel and the bottom panel, said joining structure having a bias that places the wallet in a relaxed state and applies force to draw the top and bottom panels together when the wallet is in an expanded state.

11. The wallet of claim 10, wherein the protrusion is a rectangular post that extends from the inside surface of the top panel.

12. The wallet of claim 10, wherein the receiver is an aperture in the inner surface of the bottom panel.

13. The wallet of claim 10, wherein the paired complementary structure is positioned near the corners of the top and bottom panels that form the wallet.

14. The wallet of claim 10, wherein the receiver features tapered walls.

15. The wallet of claim 10, wherein the protrusion remains within the receiver both in a relaxed state and when the wallet is in an expanded state.

16. The wallet of claim 10, wherein the receiver includes an extension that extends above and away from the inside surface of the bottom panel, said extension forming an annular wall about the perimeter of the receiver and extending towards the inner surface of the top panel.

17. The wallet of claim 10, further comprising a receptacle located adjacent to the protrusion on the inside surface of the top panel, said receptacle extending towards an outer surface of the top panel and aligning with the receiver.

18. A wallet for holding data cards, the wallet including a top panel and a bottom panel forming a pocket for receiving data cards therebetween, the top panel joined to the bottom panel by a connecting structure, the connecting structure having a bias, the bias providing a force to draw the top and bottom panels together when the wallet is in an expanded state, the wallet further including at least one protrusion extending from one of the top or bottom panel and a receiver in the other of the top or bottom panel, the protrusion received in the receiver limiting lateral movement of the top panel with respect to the bottom panel.

* * * * *